US006531437B1

(12) United States Patent
Ryan et al.

(10) Patent No.: US 6,531,437 B1
(45) Date of Patent: Mar. 11, 2003

(54) SHELF STABLE, AQUEOUS HYDROGEN PEROXIDE CONTAINING CARPET CLEANING AND TREATMENT COMPOSITIONS

(76) Inventors: Tracy Ann Ryan, 611 Blue Hill Rd., River Vale, NJ (US) 07675; Frederic Albert Taraschi, 67 Westbury Ct., Skillman, NJ (US) 08558

( * ) Notice: Subject to any disclaimer, the term of this patent is extended or adjusted under 35 U.S.C. 154(b) by 0 days.

(21) Appl. No.: 09/356,291

(22) Filed: Jul. 16, 1999

(30) Foreign Application Priority Data

Jul. 16, 1998 (GB) ..... 9815416

(51) Int. Cl.[7] ..... C11D 3/00
(52) U.S. Cl. ..... 510/280; 510/278
(58) Field of Search ..... 510/280, 278

(56) References Cited

U.S. PATENT DOCUMENTS

| | | | | | |
|---|---|---|---|---|---|
| 5,492,540 | A | * | 2/1996 | Leifheit et al. | 8/111 |
| 5,728,669 | A | * | 3/1998 | Tyerech | 510/280 |
| 5,861,365 | A | * | 1/1999 | Colurciello et al. | 510/278 |
| 5,905,065 | A | * | 5/1999 | Scialla et al. | 510/280 |
| 5,928,384 | A | * | 7/1999 | Scialla et al. | 8/137 |

FOREIGN PATENT DOCUMENTS

| | | | | |
|---|---|---|---|---|
| EP | 0 385 216 A1 | 9/1990 | ..... | C11D/3/89 |
| EP | 0 735 131 A2 | 10/1996 | ..... | C11D/1/75 |
| EP | 0 794 244 A1 | 9/1997 | ..... | C11D/1/83 |
| EP | 0 803 567 A2 | 10/1997 | ..... | C11D/1/00 |
| EP | 0 839 900 A1 | 5/1998 | ..... | C11D/3/00 |
| WO | WO95/34631 | 12/1995 | ..... | C11D/3/39 |

OTHER PUBLICATIONS

Copy of GB Search Report for GB Application No. 9815416.4 dated Oct. 7, 1998.
Copy of PCT International Search Report for PCT/GB99/02302 dated Nov. 2, 1999.

* cited by examiner

*Primary Examiner*—Yogendra N. Gupta
*Assistant Examiner*—John M Petroncio
(74) *Attorney, Agent, or Firm*—Fish & Richardson P.C.

(57) ABSTRACT

Provided are aqueous cleaning and surface treatment compositions for use in the general or localized cleaning of fibers and fibrous substrates, including carpets, carpet fibers as well as textiles. The compositions include an oxidizing agent constituent, preferably hydrogen peroxide, an anionic surfactant, especially an alkyl sulfate, an organic solvent, preferably a ternary solvent system which includes ethylene glycol hexyl ether, propylene glycol methyl ether and isopropyl alcohol, and an antiresoiling compound which is essentially free of fluorine atoms, preferably one based on a polymeric material which is essentially free of fluorine atoms, and water. Preferably the composition is essentially free of fluorine atoms.

The compositions exhibit good cleaning efficacy, and excellent shelf stability exhibited by low loss of the hydrogen peroxide subsequent to accelerated aging tests.

13 Claims, No Drawings

SHELF STABLE, AQUEOUS HYDROGEN PEROXIDE CONTAINING CARPET CLEANING AND TREATMENT COMPOSITIONS

The present invention relates to compositions for the treatment of a fibrous substrate, especially carpet fibers and carpets, which imparts oil repellency as well as a cleaning benefit. More particularly the instant invention provides a shelf stable, hydrogen peroxide containing cleaning and treatment composition particularly useful with fibrous substrates, especially carpet fibers and carpets, which composition provide a significant cleaning benefit to the treated fibrous substrates.

The prior art has suggested certain compositions which are useful in the cleaning of carpets and carpet fibers. In U.S. Pat. No. 5,492,540 to Leifheit are provided carpet cleaning compositions which include hydrogen peroxide which specifically requires an ethylene glycol n-hexyl ether, which is used as the sole surfactant, or in combination only with isopropanol. No mention or demonstration of shelf stability under accelerated aging conditions are indicated in Leifheit. U.S. Pat. No. 5,728,669 to Tyrech provides hydrogen peroxide containing compositions useful for cleaning carpets.

While the prior art has proposed many such cleaning compositions, they have not uniformly met with success. Specifically, there is a real need in the art for hydrogen peroxide containing textile and carpet cleaning compositions which are particularly useful in the localized or spot cleaning of stains on carpet surfaces, especially difficult to clean stains such as cola soft drinks, grape juice, red wine, cranberry juice etc., and at the same time feature good shelf stability.

Accordingly certain deficiencies of such prior art compositions are addressed and overcome by the present invention. The present invention provides aqueous cleaning and surface treatment compositions particularly adapted for use in the general or localized cleaning of fibers and fibrous substrates (especially carpets and carpet fibers) which comprise the following constituents:

- an oxidizing agent constituent, preferably a peroxyhydrate or other agent which releases hydrogen peroxide in aqueous solution;
- an anionic surfactant, preferably one or more alkyl sulfates or salts thereof;
- an amine oxide surfactant;
- one or more organic solvents, most preferably a ternary solvent system which includes ethylene glycol hexyl ether, propylene glycol methyl ether and isopropyl alcohol;
- an antiresoiling compound which is essentially free of fluorine atoms, which is preferably based on a polymeric material which is essentially free of fluorine atoms;
- water.

The compositions according to the invention may optionally, but in some cases desirably include one or more additives including but not limited to:

- preservatives, coloring agents such as dyes and pigments, fragrances, anti-foaming agents, pH adjusting agents, buffer compositions, anti-soiling agents and resoiling inhibitors, chelating agents, optical brighteners, farther solvents or surfactants especially nonionic surfactants, as well as one or more further compositions with the proviso that such farther optional additives are essentially free of fluorine atoms.

The compositions of the invention desirably exhibit a pH of about 6–8.

The compositions of the invention desirably exhibit good shelf stability and are particularly useful with fibrous substrates, especially carpet fibers and carpets, and provides a significant cleaning benefit and imparts repellency to the treated fibrous substrates. Preferred compositions according to the invention most desirably maintain at least about 70%, yet more preferably at least about 80% of their initial hydrogen peroxide content subsequent to accelerated aging testing for 21 days as described hereafter. The compositions according to the invention desirably also retain at least about 70%, yet more preferably at least about 85% of their initial hydrogen peroxide content subsequent to room temperature (20° C.) aging for at least about 20 weeks. Such a combination of features is not believed to have been known to the art.

According to particularly preferred embodiments, the inventive compositions are essentially free of free of fluorine atoms.

The compositions of the invention include an oxidizing agent, which is preferably a peroxyhydrate or other agent which releases hydrogen peroxide in aqueous solution. Such materials are per se, known to the art. As used in this specification, a peroxyhydrate is to be understood as to encompass hydrogen peroxide as well as any material or compound which in an aqueous composition yields hydrogen peroxide. Examples of such materials and compounds include without limitation: alkali metal peroxides including sodium peroxide and potassium peroxide, alkali perborate monohydrates, alkali metal perborate tetrahydrates, alkali metal persulfate, alkali metal percarbonates, alkali metal peroxyhydrate, alkali metal peroxydihydrates, and alkali metal carbonates especially where such alkali metals are sodium or potassium. Further useful are various peroxydihydrate, and organic peroxyhydrates such as urea peroxide. Desirably the oxidizing agent is hydrogen peroxide.

The oxidizing agent, especially the preferred hydrogen peroxide is present in the inventive compositions in an amount of from about 0.05% wt. to about 3.0% wt., and more desirably is present in an amount of about 0.5–2% wt. based on the total weight of the composition.

Minor amounts of stabilizers such as one or more organic phosphonates, stannates, pyrophosphates, as well as citric acid, may be included in the compositions. The inclusion of one or more such stabilizers aids in reducing the decomposition of the hydrogen peroxide due to the presence of metal ions and or adverse pH levels in the inventive compositions. These usually form only a minor proportion (less than about 10% wt.) relative to the weight of the oxidizing agents, and are frequently included as part of commercially available hydrogen peroxide preparations.

A further constituent of the invention is an anionic surfactant. Such anionic surface active agents are frequently provided in a salt form, such as alkali metal salts, ammonium salts, amine salts, aminoalcohol salts or magnesium salts. Contemplated as useful are one or more sulfate or sulfonate compounds including: alkyl sulfates, alkyl ether sulfates, alkylamidoether sulfates, alkylaryl polyether sulfates, monoglyceride sulfates, alkylsulfonates, alkylamide sulfonates, alkylarylsulfonates, olefinsulfonates, paraffin sulfonates, alkyl sulfosuccinates, alkyl ether sulfosuccinates, alkylamide sulfosuccinates, alkyl sulfosuccinamate, alkyl sulfoacetates, alkyl phosphates, alkyl ether phosphates, acyl sarconsinates, acyl isethionates, and N-acyl taurates. Generally, the alkyl or acyl radical in these various compounds comprise a carbon chain containing 12 to 20 carbon atoms.

Particularly preferred are alkyl sulfate anionic surfactants of the formula

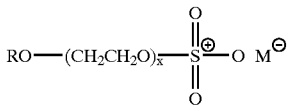

wherein R is an straight chain or branched alkyl chain having from about 8 to about 18 carbon atoms, saturated or unsaturated, and the longest linear portion of the alkyl chain is 15 carbon atoms or less on the average, M is a counterion which makes the compound water soluble especially an alkali metal such as sodium or magnesium, ammonium or substituted ammonium counterion, and x is from 0 to about 4. Most preferred are the non-ethoxylated $C_{12-15}$ primary and secondary alkyl sulfates, especially sodium lauryl sulfate.

Most desirably, the anionic surfactant according to constituent is selected to be of a type which dries to a friable powder. This facilitates their from carpets and carpet fibers, such as by brushing or vacuuming.

The anionic surfactant may be included in the present inventive compositions in an amount of from 0.001–2% wt., more preferably from 0.1 to 1% wt. based on the total weight of the composition.

The inventive compositions also include one or more amine oxide surfactants. Preferably the amine oxide surfactant may be represented by the following structure:

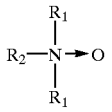

each R1 independently is a straight chained or branched $C_1$–$C_4$ alkyl group, but preferably both R1 are methyl groups; and, R2 is a straight chained or branched $C_8$–$C_{18}$ alkyl group, preferably is a $C_8$–$C_{12}$ alkyl group. Preferably, each of the R1 and R2 are straight chained. Technical grade mixtures of two or more amine oxides may be used, wherein amine oxides of varying chains of the R2 group are present. Particularly preferred are cocoamidopropyl dimethyl amine oxides.

The water dispersible amine oxide of the compositions of the invention is preferably present in an amount of from 0.01–3% wt., more preferably from 0.1–1% wt., but most preferably from 0.5–1% wt. based on the total weight of the composition.

The organic solvent constituent of the inventive compositions include one or more alcohols, glycols, acetates, ether acetates and glycol ethers. Exemplary alcohols useful in the compositions of the invention include $C_3$–$C_8$ primary and secondary alcohols which may be straight chained or branched. Exemplary alcohols include pentanol and hexanol. Exemplary glycol ethers include those glycol ethers having the general structure Ra—O—Rb—OH, wherein Ra is an alkoxy of 1 to 20 carbon atoms, or aryloxy of at least 6 carbon atoms, and Rb is an ether condensate of propylene glycol and/or ethylene glycol having from one to ten glycol monomer units. Preferred are glycol ethers having one to five glycol monomer units.

By way of further non-limiting example specific organic constituents include propylene glycol methyl ether, dipropylene glycol methyl ether, tripropylene glycol methyl ether, propylene glycol n-propyl ether, ethylene glycol n-butyl ether, diethylene glycol n-butyl ether, diethylene glycol methyl ether, propylene glycol, ethylene glycol, isopropanol, ethanol, methanol, diethylene glycol monoethyl ether acetate and particularly useful is ethylene glycol hexyl ether, diethylene glycol hexyl ether.

It has been unexpectedly found that particularly effective as the organic solvent is a ternary solvent system based on specific combinations of ethylene glycol hexyl ether, propylene glycol methyl ether, and isopropyl alcohol. The present inventors have found that such a ternary combination of these materials provides good cleaning performance, and do not deleteriously effect the stability of the hydrogen peroxide in the inventive compositions.

According to particularly preferred embodiments inventive compositions are essentially free of organic solvent constituents except for the preferred combinations of ethylene glycol hexyl ether, propylene glycol methyl ether and isopropyl alcohol described above. In this ternary solvent system the respective weight ratio of the isopropyl alcohol to the combined weights of ethylene glycol hexyl ether and propylene glycol methyl ether is from 2:1.4–0.9. More preferably the respective weight ratios of isopropyl alcohol to ethylene glycol hexyl ether to propylene glycol methyl ether is 2:0.4:0.5–1.0.

The total amounts of the organic solvent present in the inventive compositions are from about 0.001% wt. to about 10% wt. More desirably from about 0.1% wt. to about 7.5% wt., and most desirably from 2% wt. to 3.5% wt. Desirably the compositions are free from other organic solvents when the ternary solvent system indicated above is present.

The inventive compositions also include an antiresoiling compound which is essentially free of, which is preferably an antiresoiling agent based on a polymeric material which is essentially free of fluorine atoms.

An exemplary useful, and particularly preferred antiresoiling compound in the present inventive compositions are a non-halogenated, especially a non-fluorinated, acrylic polymer compounds which may be represented by the formula (A):

$$(—CH_2—CH(COOR)—)_n \quad (A)$$

wherein n is a value greater than 50.

Such a non-fluorinated acrylic polymer is presently commercially available and may be obtained as an aqueous dispersion which includes 78–79% wt. water, 20% wt. of the non-fluorinated acrylic polymer, 1% wt. of sodium lauryl sulfate, 1% wt. sodium nonylphenoxypolyethoxyethanol sulfate, and 1% wt. zinc oxide complex as SYNTRAN 1580, as well as SYNTRAN 4015, also described to be a non-fluorinated acrylic polymer. Both of these materials may be obtained from Interpolymer Corporation (Canton, Mass.).

The non-fluorinated acrylic polymer may be included in the present inventive compositions in an amount of from 0.001–2% wt., but are desirably included in amounts of from 0.1% wt.–0.75% wt., and most desirably are included in amounts of from 0.25% wt.–0.75% wt. with such recited weights being based on the weight of the non-fluorinated acrylic polymers and/or salts thereof present.

While many prior art carpet cleaning and treatment compositions are known to include one or more compounds or materials which are intended to provide an antiresoiling benefit, it has been discovered by the present applicant that such compounds or materials which include fluorine atoms may deleteriously effect the stability of aqueous compositions which also include a oxidizing agent constituent, particularly hydrogen peroxide. Accordingly, the present applicant's aqueous oxidizing agent containing compositions provide excellent shelf stability as fluorine containing antiresoiling agents are absent. In particularly preferred embodiments the inventive compositions are free of constituents which include fluorine atoms.

Optionally, but in certain instances, desirably, the inventive compositions also include minor amounts of one or more nonionic surfactants particularly alkoxylated aliphatic primary alcohols and alkoxylated aliphatic secondary alcohols, as well alkoxylated alkyl aromatic compounds. These include for example $C_8$–$C_{20}$ primary or secondary aliphatic alcohols condensed with from 2–10 moles of one or more alkylene oxides.

When present, the nonionic surfactants are present in amounts of from 0% wt. to 0.5% wt., such recited weights being based on the weight of the actives in the nonionic surfactant composition.

As is noted above, the compositions according to the invention are aqueous in nature. Water is added to order to provide 100% by weight of the compositions of the invention. The water may be tap water, but is preferably distilled and is most preferably deionized water. The inventive compositions desirably include at least 80% wt. water, more desirably include at least 85% wt. water.

The pH of the compositions of the invention are advantageously maintained between 6 and 8, and more desirably are about 7. Such may be achieved and maintained by the use of appropriate pH adjusting agents, either acids or buffers. Exemplary acids include citric acid, which is readily available, but other organic or inorganic acids may also be used. Exemplary useful pH buffering compositions include the alkali metal phosphates, polyphosphates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use buffers such materials as aluminosilicates (zeolites), borates, aluminates and certain organic materials such as gluconates, succinates, maleates, and their alkali metal salts. The present inventors have noted that the maintenance of the pH within these ranges and in particular within the preferred ranges is particularly important in order to assure the phase stability of the aqueous compositions, as well as the stability of the hydrogen peroxide of the preferred embodiments. Particularly useful as pH adjusting agents are citric acid and sodium citrate which are widely available and very effective. Such pH adjusting agents or pH buffers are generally required in only minor amounts, with amounts of about 1% wt. and less based on the total weight of the composition.

Certain particularly preferred embodiments include a one or more chelants selected from phosphonate chelants. To be avoided are amino carboxylate chelants, such as ethylenediaminetetraacetic acid as these are incompatible with the preferred hydrogen peroxide.

Particularly useful are phosphonate chelants which include organic amino phosphonate compounds, such as a amino aklylene poly(alkylene phosphonate), alkali metal ethane 1-hydroxy diphosphonates, nitrilo trimethylene phosphonates, ethylene diamine tetra methylene phosphonates, and diethylene triamine penta methylene phosphonates. The phosphonate compounds may be present either in their acid form or as salts of different cations on some or all of their acid functionalities. Preferred phosphonate chelants to be used herein are diethylene triamine penta methylene phosphonates. Such phosphonate chelants are commecially available from Monsanto under the trade name DEQUEST from Solutia Inc., formerly from Monsanto Co. (St. Louis, Mo.). When present, the chelant, especially the phosphonte chelant is included in amounts of from 0–1% wt., preferably 0.001–0.5% wt.

Such constituents as described above as essential and/or optional constituents are per se, known to the art.

It is to be understood that although the aqueous cleaning compositions taught herein have been generally discussed in conjunction with the cleaning of carpets and carpet fibers, they may be used in the cleaning of a wide variety of fibers and fibrous substrates such as fabrics and textiles, rugs, carpets, mats, screens, articles of apparel such as scarves, gloves and the like may also be treated.

The compositions of the invention can be prepared in a conventional manner such as by simply mixing the constituents in order to form the ultimate aqueous cleaning composition. The order of addition is not critical.

The compositions of this invention may be packaged in any suitable container, such as an unpressurized bottle or in a pressurized container. They may be pressurized and made available in this form by means of the addition of a suitable propellant to the composition such as known hydrocarbon propellants including propane, butane, isobutane, and isopentane, halogenated hydrocarbon propellants including chlorodifluoromethane, difluoroethane dichlorodifluoromethane as well as pressurized gases such as carbon dioxide and nitrogen. Most desirably, the compositions are packaged and provided in a container especially a pressurized vessel or a manually operable pump which induces foaming of the composition as it is dispensed from the container.

The compositions according to the invention are used in a conventional manner in the cleaning of carpet surfaces. Carpets are effectively cleaned by spraying about 10–100 grams per square foot of the carpeted surface with the aqueous cleaning composition and subsequently allowing said composition to penetrate amongst the carpet surface and the fibers. Optionally, the treated carpet are agitated using a device such as a brush, sponge, mop, cloth, non-woven cloth, to intermix the applied composition among the carpet fibers. Subsequently, the treated composition is permitted to dry, and optionally, but desirably, any remaining cleaning composition may be removed from the carpet such as by vacuuming in a conventional manner.

The hydrogen peroxide containing aqueous cleaning compositions according to the present invention provide good cleaning efficacy, and exhibit excellent shelf stability nothwithstanding the presence of a significant amount of hydrogen peroxide.

The following examples illustrate the superior properties of the formulations of the invention and particular preferred embodiments of the inventive compositions. The terms "parts by weight" or "percentage weight" as well as "% wt." are used interchangeably in the specification and in the following Examples wherein the weight percentages of each of the individual constituents are indicated in weight percent based on the total weight of the composition, unless indicated otherwise.

EXAMPLES

Illustrative exemplary formulations within the scope of the present inventive compositions are provided on Table 1 below, which are designated as "Example" or "Ex." formulations.

TABLE 1

| | Ex. 1 | Ex. 2 | Ex. 3 | Ex. 4 | Ex. 5 | Ex. 6 | Ex. 7 | Ex. 8 | Ex. 9 | Ex. 10 | Ex. 11 |
|---|---|---|---|---|---|---|---|---|---|---|---|
| STEPANOL WAC | 2.62 | 2.62 | — | 1.75 | 1.75 | 1.75 | 1.75 | 2.00 | 2.50 | 1.50 | 2.50 |
| STEPANOL MG | — | — | 2.62 | — | — | — | — | — | — | — | — |
| AMMONYX CDO special | 3.30 | 3.30 | 3.30 | 3.30 | 3.30 | 3.30 | 3.30 | 2.40 | 3.30 | 3.30 | 1.50 |
| HEXYL CELLOSOLVE | — | — | — | — | — | — | — | 0.40 | 0.40 | 0.40 | 0.40 |
| BUTYL CELLOSOLVE | — | 1.50 | — | — | — | — | — | — | — | — | — |
| HEXYL CARBITOL | 1.20 | 1.20 | 1.20 | 1.20 | 0.60 | 0.60 | 0.60 | — | — | — | — |
| IPA | — | — | — | 2.00 | 2.00 | 2.00 | 2.00 | 2.00 | 2.00 | 2.00 | 2.00 |
| DOWANOL PM | — | — | — | — | — | 0.60 | 1.00 | 0.75 | 1.00 | 1.00 | 1.00 |
| DOWANOL DM | — | — | — | — | 0.60 | — | — | — | — | — | — |
| DOWANOL PNB | 1.50 | — | 1.50 | — | — | — | — | — | — | — | — |
| CITRIC ACID | 0.08 | 0.08 | 0.08 | 0.08 | 0.08 | 0.08 | 0.04 | 0.08 | 0.08 | 0.08 | 0.08 |
| FMC SUPER D | 3.00 | 3.00 | 3.00 | 3.00 | 4.00 | 3.00 | 3.00 | 3.00 | 3.00 | 3.00 | 3.00 |
| SYNTRAN 1580 | 3.00 | 3.00 | 3.00 | 1.75 | 1.75 | 1.75 | 1.75 | 2.25 | 3.00 | 3.00 | 3.00 |
| DEQUEST 2066 | — | — | — | — | — | — | — | — | — | — | — |
| FRAGRANCE | — | — | — | — | — | — | — | — | — | — | — |
| DI WATER | 85.30 | 85.30 | 85.30 | 86.92 | 85.92 | 86.92 | 86.86 | 87.12 | 84.72 | 85.72 | 86.52 |
| PH | 7.04 | 7.04 | 6.83 | 6.67 | 6.82 | 6.82 | 7.24 | 7.06 | 7.29 | 7.30 | 7.13 |

| | Ex. 12 | Ex. 13 | Ex. 14 | Ex. 15 | Ex. 16 | Ex. 17 | Ex. 18 | Ex. 19 | Ex. 20 | Ex. 21 | Ex. 22 | Ex. 23 |
|---|---|---|---|---|---|---|---|---|---|---|---|---|
| STEPANOL WAC | 1.50 | 2.50 | 2.50 | 2.00 | 2.0 | 2.0 | 2.0 | 2.0 | 2.5 | 1.5 | 2.5 | 1.5 |
| STEPANOL MG | — | — | — | — | — | — | — | — | — | — | — | — |
| AMMONYX CDO special | 1.50 | 3.30 | 3.30 | 2.40 | 2.40 | 2.40 | 2.40 | 2.40 | 1.5 | 1.5 | 3.3 | 3.3 |
| HEXYL CELLOSOLVE | 0.40 | 0.40 | 0.40 | 0.40 | 0.40 | 0.40 | 0.40 | 0.40 | 0.40 | 0.40 | 0.4 | 0.4 |
| BUTYL CELLOSOLVE | — | — | — | — | — | — | — | — | — | — | — | — |
| HEXYL CARBITOL | — | — | — | — | — | — | — | — | — | — | — | — |
| IPA | 2.00 | 2.00 | 2.00 | 2.25 | 2.0 | 2.0 | 2.0 | 2.0 | 2.0 | 2.0 | 2.0 | 2.0 |
| DOWANOL PM | 0.50 | 0.50 | 0.50 | 1.00 | 0.75 | 0.75 | 0.75 | 0.75 | 0.5 | 1.0 | 1.0 | 0.5 |
| DOWANOL DM | — | — | — | — | — | — | — | — | — | — | — | — |
| DOWANOL PNB | — | — | — | — | — | — | — | — | — | — | — | — |
| CITRIC ACID | 0.08 | 0.08 | 0.08 | 0.08 | 0.08 | 0.08 | 0.08 | 0.08 | 0.08 | 0.08 | 0.08 | 0.08 |
| FMC SUPER D | 3.00 | 3.00 | 3.00 | 3.00 | 3.00 | 3.00 | 3.00 | 3.00 | 3.0 | 3.0 | 3.0 | 3.0 |
| SYNTRAN 1580 | 3.00 | 3.00 | 1.50 | 2.25 | 2.25 | 2.25 | 2.25 | 2.25 | 3.0 | 3.0 | 1.5 | 1.5 |
| DEQUEST 2066 | — | — | — | 0.50 | — | — | — | — | — | — | — | — |
| FRAGRANCE | — | — | — | — | 0.20 | 0.20 | 0.20 | 0.20 | — | — | — | — |
| DI WATER | 88.02 | 85.22 | 86.72 | 86.12 | 86.92 | 86.92 | 86.92 | 86.92 | 87.02 | 87.52 | 86.22 | 87.72 |
| PH | 7.12 | 7.29 | 6.93 | 6.98 | 7.19 | 7.10 | 6.85 | 6.94 | 7.21 | 7.13 | 7.15 | 6.82 |

It is to be understood that the amounts of the constituents are listed above are "as is" weights as supplied by the respective supplier. The identity of the individual constituents described in Table 1 above, their percentage by weight 'actives', as well as presently available commercial sources, are described in more detail in Table 2, below.

TABLE 2

| | |
|---|---|
| STEPANOL WAC | sodium lauryl sulfate (30% wt. actives) (Stepan Corp.) |
| STEPANOL MG | magnesium lauryl sulfate (30% wt. actives) (Stepan Co.) |
| AMMONYX CDO special | cocoamidopropyl dimethyl amine oxides. (32% wt. actives) |
| HEXYL CELLOSOLVE | ethylene glycol monohexyl ether (100% wt. actives) (Union Carbide Corp.) |
| HEXYL CARBITOL | diethylene glycol monohexyl ether (100% wt. actives) (Union Carbide Corp.) |
| BUTYL CELLOSOLVE | ethylene glycol butyl ether (100% wt. actives) (Union Carbide Corp.) |
| DOWANOL PNB | propylene glycol n-butyl ether (100% wt. actives) (Dow Chem. Co.) |
| DOWANOL PM | propylene glycol methyl ether (100% wt. actives) (Dow Chem. Co.) |
| DOWANOL DM | diethylene glycol methyl ether (100% wt. actives) (Dow Chem. Co.) |
| IPA | isopropanol, technical grade (at least 95% wt. actives) |
| CITRIC ACID | citric acid, anhydrous |
| SODIUM CITRATE | sodium citrate, anhydrous |
| FMC SUPER D | hydrogen peroxide, cosmetic grade (50% wt. actives) (FMC Corp.) |

TABLE 2-continued

| | |
|---|---|
| SYNTRAN 1580 | non-fluorinated acrylic copolymer (20% wt. actives) (Interpolymer Corp.) |
| DEQUEST 2066 | diethylenetriaminepenta(methylene phosphonic acid), sodium salt (55% wt. actives) (Solutia Corp., St. Louis, MO) |
| DI WATER | deionized water |

Certain of the formulations described on Table 1 were subjected to various tests including "normal" and "accelerated" aging tests during which initial evaluation of the levels of hydrogen peroxide as well as pH, and hydrogen peroxide levels and pH subsequent to testing was performed. In the normal aging test, compositions were evaluated at room temperature (68° F., 20° C.) In accordance with the accelerated aging test, a sample of a particular formulation is placed in a glass vessel and subjected to temperature of 120° F. (48.8° C.) for a various intervals of weeks. The results are reported on Table 3, below.

TABLE 3

| | Ex. 4 | Ex. 5 | Ex. 6 | Ex. 7 | Ex. 8 | Ex. 15 | Ex. 16 | Ex. 17 | Ex. 18 | Ex. 19 |
|---|---|---|---|---|---|---|---|---|---|---|
| % wt. $H_2O_2$, initial | 1.61 | 2.08 | 1.57 | 1.64 | 1.55 | 1.56 | 1.56 | 1.54 | 1.58 | 1.63 |
| # of WEEKS | 4 weeks | 1 week | 4 weeks | 4 weeks | 7 weeks | 4 weeks | 6 weeks | 6 weeks | 6 weeks | 3 weeks |
| % loss $H_2O_2$, at room temp. | 0.00 | 0.00 | 0.00 | 5.00 | 0.65 | 2.00 | 2.5 | 0 | 2.20 | 4.30 |
| % loss $H_2O_2$, at 120° F. | 13.00 | 5.00 | 11.00 | 25.00 | 31.0 | 5.00 | 18.0 | 19.10 | 22.5 | 15.30 |

These formulations are expected to provide a good cleaning benefit and to provide excellent stain removal of carpeted surfaces due to the presence of effective amounts of hydrogen peroxide, which is also present in sufficient amounts to act as an effective oxidizing agent. The formulations are also at an appropriate pH for oxidizing (bleaching) difficult to remove stains, such as grape juice, red wine, and the like.

The compositions of the invention also provide good cleaning of stained or soiled carpet surfaces.

The deleterious effect of fluorine atoms on the stability of the inventive compositions is shown by the following. Two formulations, as indicated on Table 4 were produced from the constituents described on Table 2 and subjected to hydrogen peroxide stability testing.

TABLE 4

| | Ex. 8 | Comp. 1 |
|---|---|---|
| STEPANOL WAC | 2.00 | 2.00 |
| AMMONYX CDO special | 2.40 | 2.40 |
| HEXYL CELLOSOLVE | 0.40 | 0.40 |
| IPA | 2.00 | 2.00 |
| DOWANOL PM | 0.75 | 0.75 |
| CITRIC ACID | 0.08 | 0.08 |
| FMC SUPER D | 3.00 | 3.00 |
| SYNTRAN 1580 | 2.25 | — |
| ZONYL 7950 | — | 0.4 |
| DEQUEST 2066 | — | — |
| DI WATER | 87.12 | 87.12 |

The first formulation according to the invention was the same as Ex.8 described in Table 1. The comparative formulation ("Comp. 1") was similar to that of Ex.8 denoted above, included a fluorine containing anti-resoiling agent, ZONYL 7950, a fluorosurfactant available from E.I. DuPont Co.

Table 5, below, illustrates the hydrogen peroxide stability of these two compositions which were tested in the manner described above with reference to Table 4.

TABLE 5

| | Ex. 8 | Comp. 1 |
|---|---|---|
| % loss $H_2O_2$, at room temp, after 2 days | — | 45 |
| % loss $H_2O_2$, at 120° F., after 2 days | — | 88.9 |
| % loss $H_2O_2$, at room temp, after 2 weeks | 0.00 | — |
| % loss $H_2O_2$, at 120° F., after 2 weeks | 7.80 | — |

"—" indicates not tested.

As is shown on the table, the inclusion of the fluorine containing anti-resoiling agent appeared to cause the substantial degradation of the hydrogen peroxide in the short time interval of 2 days. The composition according to Ex.8 exhibited good hydrogen peroxide stability after 2 weeks under the same conditions.

The excellent stability of the inventive compositions is demonstrated by the following Table 6. Samples of a commercially available product, SHOUT Carpet Cleaner (S.C. Johnson & Son. Co., Racine Wis.) packaged in a non-pressurized trigger spray bottle and a sample of the formulation according to Ex. 17 were tested in the manner described above with reference to Table 3. The SHOUT product is believed to be a hydrogen peroxide containing composition.

TABLE 6

| 6 weeks of testing | Ex. 17 | SHOUT (Comp. 2) |
|---|---|---|
| % loss $H_2O_2$, at room temp | 0% | 6.5% |
| % loss $H_2O_2$, at 105° F. (40.5° C.) | 4.2% | 21% |

As seen from the results on Table 6, the inventive compositions clearly outperformed the commercial product with respect to hydrogen peroxide stability.

What is claimed is:

1. Aqueous cleaning and surface treatment compositions adapted for cleaning of fibers and fibrous substrates comprising:

an oxidizing agent constituent;

an anionic surfactant;

an amine oxide surfactant;

as organic solvents, a ternary solvent system which includes ethylene glycol hexyl ether, propylene glycol methyl ether and isopropyl alcohol, an antiresoiling compound which is essentially free of fluorine atoms, water.

2. The composition according to claim 1, wherein the oxidizing agent constituent is a peroxyhydrate or other agent which releases hydrogen peroxide in aqueous solution.

3. The composition according to claim 2, wherein the oxidizing agent is hydrogen peroxide.

4. The composition according to claim 1 wherein anionic surfactant is one which may be represented by the formula:

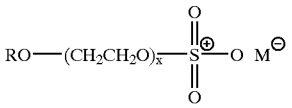

wherein R is an straight chain or branched alkyl chain having from about 8 to about 18 carbon atoms, saturated or unsaturated, M is a cation which makes the compound water soluble, and x is from 0 to about 4.

5. The composition according to claim 1 wherein the amine oxide surfactant may be represented by the following structure:

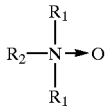

wherein:

each $R_1$ independently is a straight chained or branched $C_1$–$C_4$ alkyl group, and, $R_2$ is a straight chained or branched $C_8$–$C_{18}$ alkyl group.

6. The compositions according to claim 1 wherein the respective weight ratios of the isopropyl alcohol to the combined weights of ethylene glycol hexyl ether and propylene glycol methyl ether is from 2:1.4–0.9.

7. The compositions according to claim 6 wherein the respective weight ratios of isopropyl alcohol to ethylene glycol hexyl ether to propylene glycol methyl ether is 2:0.4:0.5–1.0.

8. The compositions according to claim 1, wherein said compositions are essentially fee of fluorine atoms.

9. A process for the general or localized cleaning of carpets and carpet fibers which comprises the step of:

applying a cleaning effective amount of a composition according to claim 1 to carpets or carpet fibers.

10. The composition according to claim 1 wherein the anionic surfactants are one or more selected from: alkyl sulfates, alkyl ether sulfates, alkylamidoether sulfates, alkylaryl polyether sulfates, monoglyceride sulfates, alkylsulfonates, alkylamide sulfonates, alkylarylsulfonates, olefinsulfonates, paraffin sulfonates, alkyl sulfosuccinates, alkyl ether sulfosuccinates, alkylamide sulfosuccinates, alkyl sulfosuccinamate, alkyl sulfoacetates, alkyl phosphates, alkyl ether phosphates, acyl sarcosinate, acyl isethionates, and N-acyl taurates as well as salt forms thereof.

11. The composition according to claim 10 wherein the anionic surfactants are one or more one or more alkyl sulfates or salts thereof.

12. The composition according to claim 1 which is free of constituents which include fluorine atoms.

13. The composition according to claim 1 wherein the antiresoiling compound is a polymeric material which is essentially free of fluorine atoms.

* * * * *

UNITED STATES PATENT AND TRADEMARK OFFICE

CERTIFICATE OF CORRECTION

PATENT NO. : 6,531,437 B1 
DATED : March 11, 2003
INVENTOR(S) : Tracy Ann Ryan and Frederic Albert Taraschi It is certified that error appears in the above-identified patent and that said Letters Patent is hereby corrected as shown below:

Title page,
Please add Assignee information as follows:

-- [73] Assignee: Reckitt Benckiser Inc., Wayne, New Jersey --

Signed and Sealed this

Twenty-sixth Day of August, 2003

JAMES E. ROGAN
*Director of the United States Patent and Trademark Office*